US008905486B2

(12) United States Patent
Delabbio et al.

(10) Patent No.: US 8,905,486 B2
(45) Date of Patent: Dec. 9, 2014

(54) UNDERGROUND MINING

(75) Inventors: Fredric Christopher Delabbio, Samford (AU); Max Edward Oddie, Sorrento (AU)

(73) Assignee: Technological Resources Pty. Ltd., Melbourne, Victoria (AU)

( * ) Notice: Subject to any disclaimer, the term of this patent is extended or adjusted under 35 U.S.C. 154(b) by 256 days.

(21) Appl. No.: 13/381,470

(22) PCT Filed: Jun. 30, 2010

(86) PCT No.: PCT/AU2010/000821

§ 371 (c)(1),
(2), (4) Date: Apr. 17, 2012

(87) PCT Pub. No.: WO2011/000038

PCT Pub. Date: Jan. 6, 2011

(65) Prior Publication Data

US 2012/0200139 A1 Aug. 9, 2012

(30) Foreign Application Priority Data

Jun. 30, 2009 (AU) ..... 2009903057

(51) Int. Cl.

| | |
|---|---|
| ***E21C 41/16*** | (2006.01) |
| ***E21D 1/03*** | (2006.01) |
| ***E21D 9/12*** | (2006.01) |
| ***E21D 1/06*** | (2006.01) |
| ***E21D 1/08*** | (2006.01) |
| ***E21D 9/00*** | (2006.01) |

(52) U.S. Cl.

CPC .. *E21D 1/08* (2013.01); *E21D 9/12* (2013.01); *E21D 1/06* (2013.01); *E21D 9/00* (2013.01)

USPC ..... 299/19; 299/18

(58) Field of Classification Search

USPC ..... 299/18, 19, 64

See application file for complete search history.

(56) References Cited

U.S. PATENT DOCUMENTS

| | | | | | |
|---|---|---|---|---|---|
| 925,274 | A | * | 6/1909 | Belloni | 454/171 |
| 2,937,773 | A | * | 5/1960 | O'Leary et al. | 187/409 |
| 3,582,138 | A | * | 6/1971 | Loofbourow et al. | 299/13 |
| 3,965,995 | A | | 6/1976 | Sugden | |
| 4,548,442 | A | * | 10/1985 | Sugden et al. | 299/10 |
| 4,646,853 | A | * | 3/1987 | Sugden et al. | 175/94 |

FOREIGN PATENT DOCUMENTS

JP 2006-249793 9/2006

OTHER PUBLICATIONS

International Search Report in International Application No. PCT/AU2010/000821; Mailing Date: Aug. 16, 2010.

Cheng Wen-Lon, Planning and Design of the Hsuehshan Tunnel, pp. 1-23, date unknown.

Tseng Dar-jen, et al, Additional Working Faces through the Shaft of Hsuehshan Tunnel, Tunnel Construction, Sup. pp. 337-343. dated Aug. 2007 (with English Abstract and partial translation).

* cited by examiner

*Primary Examiner* — John Kreck

(74) *Attorney, Agent, or Firm* — Banner & Witcoff, Ltd.

(57) ABSTRACT

In developing an underground mine a mine shaft 80 is formed by excavating earth and removing excavated material from the shaft 80 by a material transport system comprising skips 36 movable up and down on skip guides within the shaft. Tunnels 82 are launched from a bottom part of shaft 80 by excavating a cavern 81 in which a tunnel boring machine is assembled and operated to bore the tunnels 82. Material from the tunnel excavation is transported from the tunnels via conveyor 87 to the material transport system established within the shaft during formation of the shaft which is operated to transport that material to an earth surface region.

20 Claims, 9 Drawing Sheets

UNDERGROUND MINING

CROSS-REFERENCE TO RELATED APPLICATIONS

This application is a national phase application of International Application No. PCT/AU2010/000821, filed Jun. 30, 2010, and claims the priority of Australian Application No. 2009903057, filed Jun. 30, 2009, the content of both of which is incorporated herein by reference.

FIELD OF THE INVENTION

This invention relation to underground mining and in particular, to the activity which needs to be carried out in the early stages of developing an underground mine.

BACKGROUND OF THE INVENTION

Modern large block cave mines require a significant time to develop and a very significant early investment. Both of these factors make their financial success in terms of net present value extremely sensitive to the speed at which they can be brought on stream. Deep cave mines require shaft access and the development of this shaft access forms the initial part of the mine development and therefore is directly on the project critical path i.e. until the initial shafts are completed no other underground development activity can be commenced.

After the initial shafts have been sunk, tunnels can be launched from the shafts in an appropriate pattern for block cave mining and the material excavated in the tunnelling operation transported to the surface through the shafts. The shafts must be equipped with a material transport system capable of removing material excavated during tunnelling and subsequently from the operating mine. Conventionally this system is installed after the shaft sinking operation and before tunnel launch which causes significant delay in the mine development project. By the present invention, such delay can be avoided or much reduced by establishing a material transport system within the shaft during formation of the shaft and using that system for transport of material excavated during the subsequent tunnelling operation.

SUMMARY OF THE INVENTION

The invention provides a method of developing an underground mine, comprising:

forming a mine shaft by excavating earth to form a hole extending downwardly from an earth surface region;

removing excavated material from the hole during the formation of the shaft by a material transport system operable to transport the excavated material upwardly through the hole to the earth surface region for discharge at the surface region;

launching one or more tunnels from a bottom part of the shaft when formed by excavating outwardly from the shaft; and removing material excavated in the tunnel excavation by transporting that material from the tunnel to the material transport system established during formation of the shaft and operating that system to transport the material to the surface region.

The tunnel launching may be carried out by firstly excavating a cavern at the bottom part of the shaft and then excavating a tunnel or tunnels from the cavern.

The cavern may be excavated to extend to opposite sides of the shaft.

The cavern may be excavated by drilling and blasting and removing excavated material.

Tunnel boring machine components may be lowered down the shaft and assembled within the cavern into a tunnel boring machine operable to bore outwardly from the cavern to form the tunnel or tunnels.

The excavation of earth to form the shaft may be carried out by an excavator disposed below the material transport system for transporting excavated material to the surface region. In that case the excavator may be an earth boring machine comprising a rotary cutting head.

On completion of the shaft formation and prior to the tunnel launch the excavator may be wholly or partly salvaged by removing parts and hoisting the removed parts up the shaft to the earth surface region. However, the excavator or part of the excavator could be buried at the bottom of the shaft prior to the tunnel launch.

The material transport system may comprise one or more skips moveable up and down on skip guides within the hole and a transfer station at which material excavated in the formation of the shaft is transferred into the skip or skips for transport to the surface region and the transfer station is moved downwardly as excavation progresses.

On completion of the shaft formation, the transfer station may be located at or near the bottom of the shaft and the tunnel excavation material may be fed to the transfer station for transfer into the skip or skips.

There may be a pair of said skips movable up and down within the shaft along adjacent pathways to in turn receive excavated material and transport that material to the surface region for discharge at the surface region and to then return downwardly to the transfer station and a pair of bins at the transfer station to receive excavated material and to discharge discrete loads of that material intermittently into the skips.

The excavation of earth to form the shaft may be carried out by an earth boring machine comprising a rotary cutting head disposed below the material transport system for transporting excavated material to the surface region. The earth boring machine may be fitted above the cutting head with rock drills operable to drill outwardly extending holes about the periphery of the shaft hole and excavation of the cavern may be initiated by operating the rock drills to form outwardly extending blast holes about the periphery of the shaft hole at the bottom part of the shaft hole, setting and detonating explosive charges within the blast holes to excavate an initial station from which the cavern and tunnel or tunnels may be developed.

BRIEF DESCRIPTION OF THE DRAWINGS

In order that the invention may be more fully explained, one particular embodiment will be described in detail with reference to the accompanying drawings in which.

DETAILED DESCRIPTION OF THE PREFERRED EMBODIMENT

Figure 1:
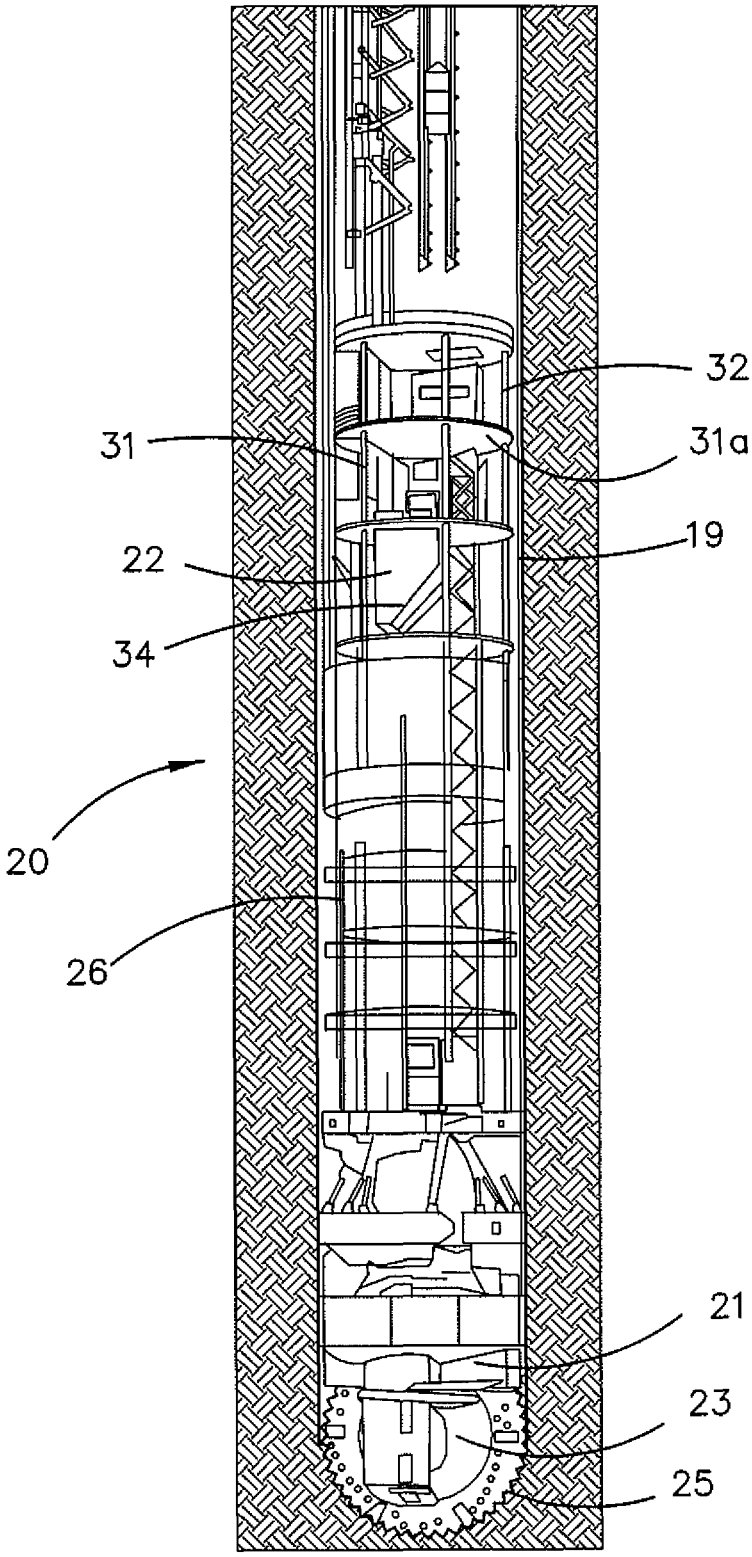
FIG. 1 illustrates a shaft sinking system.
Figure 2:
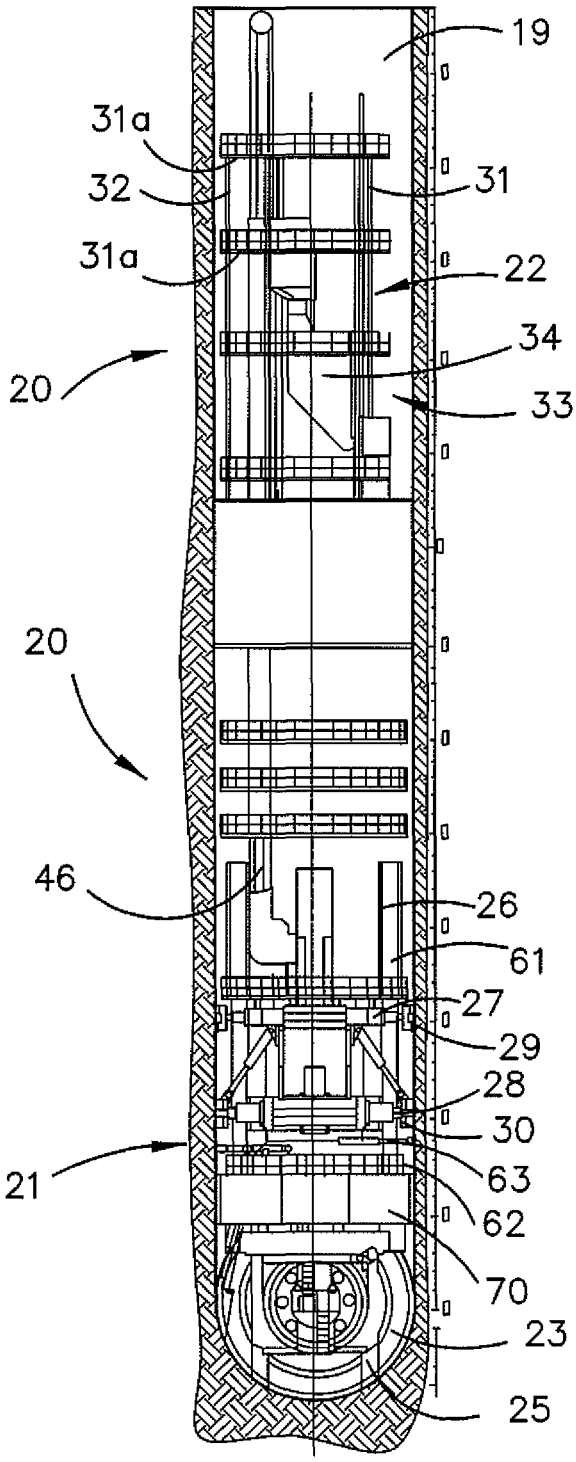
FIG. 2 is a vertical cross-section through the shaft sinking system.
Figure 3:
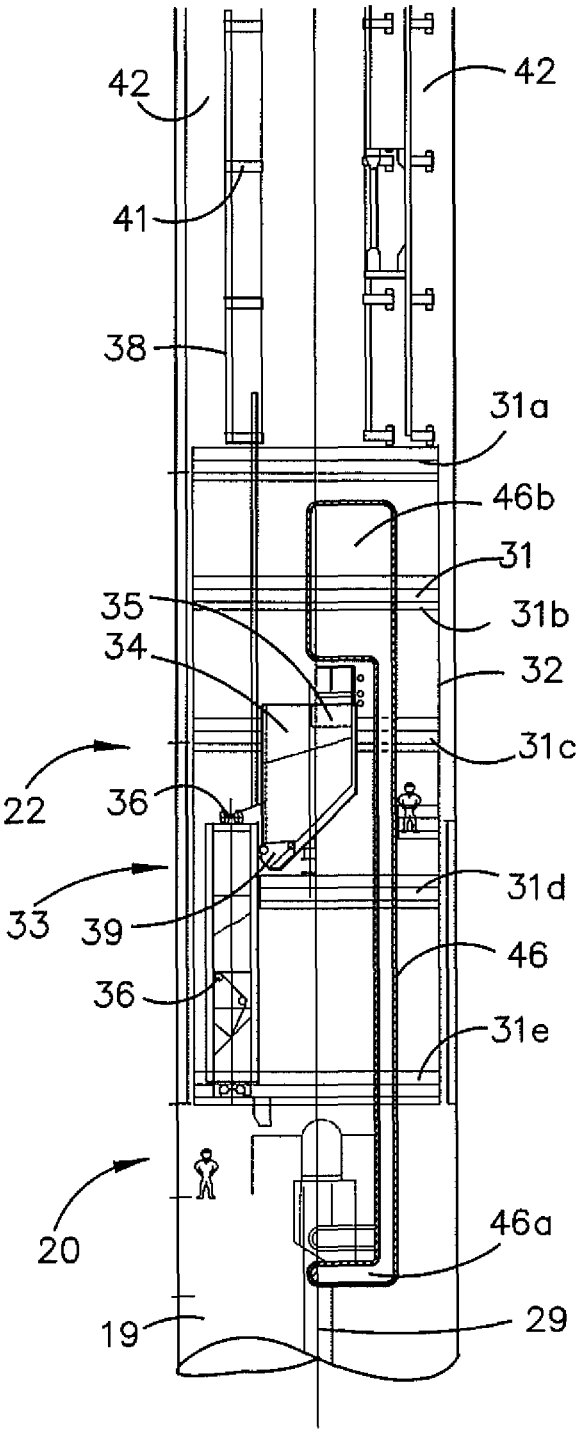
FIG. 3 is a vertical section through an upper part of the system.

FIGS. 1 to 5 illustrate a mine shaft boring apparatus denoted generally as 20 located in a shaft hole 19. This apparatus comprises a boring machine 21 and an excavated material handling unit 22 disposed above the boring machine and operable to receive excavated material from the boring machine and to transfer it to skips for transport to ground level and discharge at ground level to appropriate conveying equipment or other transport for disposal.

Earth boring machine 21 has a rotary cutting head 23 fitted with cutters 25 and is mounted at the lower end of a main machine frame 26. The cutter head is rotatable about a vertical axis so that the machine is operable to bore a generally cylindrically shaped hole. A bucket conveyor 29 transports the excavated material from the cutter head upwardly to the material handling unit 22 disposed above the boring machine.

The main machine frame 26 can be stabilised or locked into position within the bored hole by operation of hydraulically actuated stabilising jacks 27, 28 which operate upper and lower grippers 29, 30 to grip the sidewalls of the shaft to stabilise the position of the boring machine in the shaft. The boring machine can be advanced downwardly by incremental advancement of the main frame 26 by operation of the stabilising jacks 27, 28 and grippers 29, 30 in known fashion.

The material handling unit 22 is mounted on a galloway or main frame 31 formed by a series of platforms or decks 31*a* interconnected by circumferentially spaced vertical studs 32. The cutter head is fitted with cutters 25 and is carried on a rotatable column 30 mounted in a main machine frame 26.

Galloway 31 may be lowered into the shaft on cables and supported independently of boring machine 21 although in an alternative arrangement as described below the galloway may be supported on the body of the boring machine.

Material handling unit 22 comprises a material transfer station 33 including a pair of storage bins in the form of hoppers 34 mounted side by side on galloway 31. The galloway also supports a bucket conveyor 46 which transports excavated material from boring machine 21 upwardly through the shaft to a location above the transfer station from which it discharges the excavated material onto discharge ramps 35 and into the bins 34. Conveyor 46 operates continuously to feed excavated material into the bins and the material is discharged sequentially from the bins into a pair of skips 36 hoisted on cables 40 from ground level and fitted with wheels 37 which run on vertical guides 38 fitted to the shaft in the manner to be described below.

Figure 6:
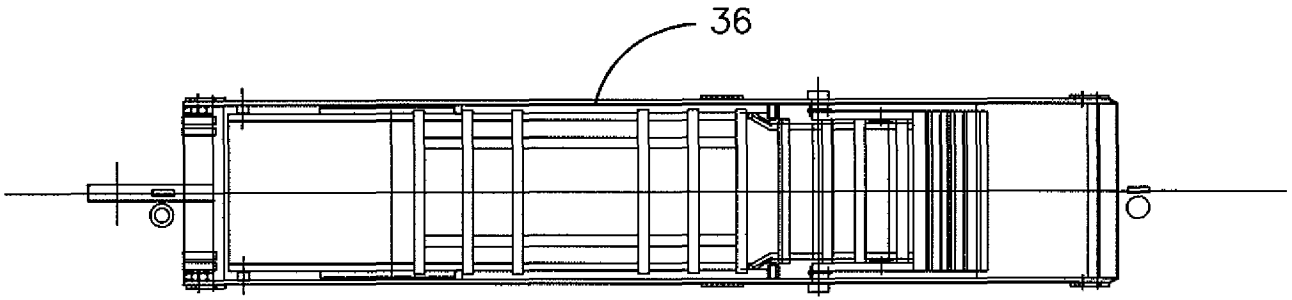
FIGS. 6 and 7 illustrate the construction of a pair of skips incorporated in the system.
Figure 7:
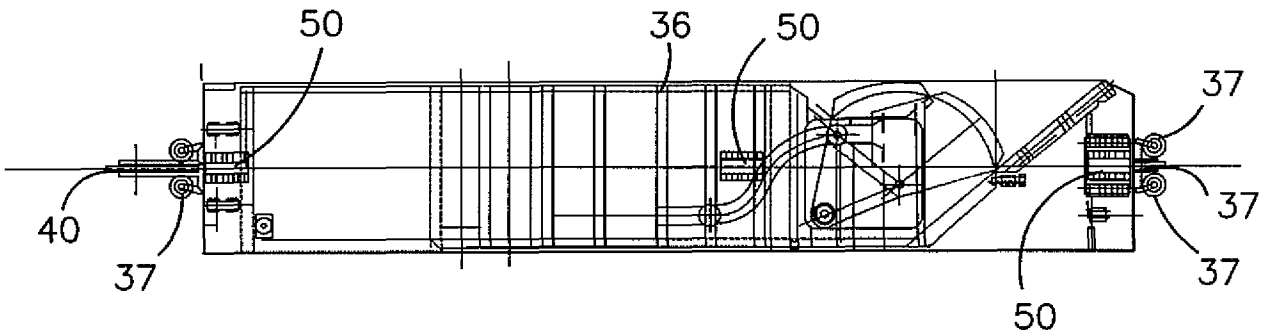

Skips 36 may be arc gate bottom dump skips as shown in FIGS. 6 and 7. The top and bottom of each skip is fitted with two sets of wheels 37 to run on three sides of the respective vertical guides 38. Each skip is also fitted with open channel runners 50 lined with wear blocks to run along the guide.

Skips 36 are operated in tandem so that as one skip is hoisted from the transfer station 33 to ground level, the other skip is lowered to the loading station. When a skip 36 reaches the loading station the bottom floor of the respective bin 34 is moved to discharge material stored in the bin through discharge opening 39 into the skip. The contents of the bin empties quickly into the skip and the bottom door of the bin is closed. Each bin has sufficient capacity to accumulate material continuously from conveyor 46 as the skip is hoisted to the surface, its contents discharged by opening the bottom arc gate and the skip relowered to the loading station.

Skips 36 are formed as long rectangular containers which are disposed so as to extend vertically along a side section or segment 52 of the shaft. This section of the shaft, which occupies considerably less than 50% of the shaft cross-section may be divided from the remainder of the shaft space by steel formwork carrying the skip guides 38 and set into a shaft lining 42 installed within the shaft as boring progresses. Typically the maximum width side segment 52 of the shaft may be no more than about one third of the shaft diameter.

Figure 4:
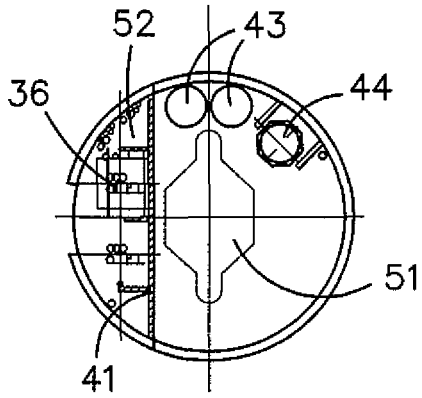
FIGS. 4 and 5 are horizontal cross-sections through the upper part of the system shown in FIG. 3.
Figure 5:
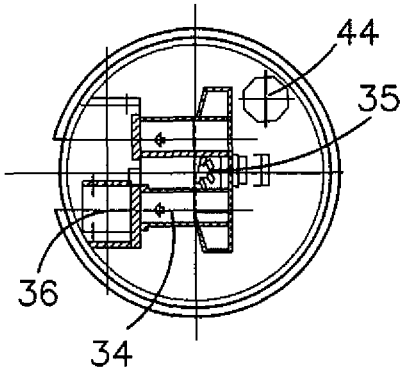

As shown in FIG. 4, the shaft may be fitted with air ducts 43 and a delivery bucket or lift 44 for delivery of men and materials to the decks of galloway 34 and the mainframe of the boring machine, a central region 51 of the shaft remaining available as a heave lift compartment.

Because skips 36 are constrained to run on guides which are firmly anchored to the shaft lining through the formwork 41 they can be of very robust construction and can be raised and lowered along the guides and within the protective formwork much more rapidly than the receptacles previously used for transmitting excavated material to the surface. The lining 42 may be formed of concrete and to enable progressive extension of the lining and the guides for the skips the shaft lining and strip guides may be extended by installation of successive lining and skip guide extensions below the transfer station 33 while material is being conveyed and transferred in advance of movements of the skips into the extensions of the lining as shaft sinking proceeds.

As shaft boring operations proceed the boring machine may be advanced in successive increments by alternate operation of the stabilising jacks 27, 28 to allow the machine to move down the hole. The bottom end of conveyor is vertically extensible by movement of a bottom loop 46*a* of the conveyor with compensating movement of an upper loop 46*b* to allow continued transport of excavated material by the conveyor to the transfer station and discharge into hoppers 34 without moving the transfer station as the cutter head of the boring machine and the conveyor 29 moves through a limited distance. During this time, an extension of the shaft lining 34 can be installed below the transfer station, more specifically, immediately below the lowermost positions of the skips 36 during the then current material transfer and hoisting operations.

The lining may be installed by spraying concrete directly onto the bored hole through a slick line extending from the surface and supplying concrete through a distributor to one or more, typically two, manually operated application hoses. Alternatively, the lining can be assembled from precast components and attached to the wall by bolting or other convenient means. Extensions of the skip guides and skip guide formwork can then be installed so as to be firmly anchored to the lining. The unit 22 can then be lowered so that the loading station is lowered and the skips 36 allowed to run onto the extended guides within the extended lining. If the lining is applied in wet form to the bore hole by spraying or other means, sufficient time will need to be allowed for the concrete to cure before the loading station is lowered.

Although in the illustrated embodiment the material handling unit 22 is supported independently of the boring machine 21, this is not essential and in an alternative arrangement the galloway carrying the loading station may be supported directly on the main frame of the boring machine. In such an arrangement the loading station will be supported and firmly held in position with the main frame of the boring machine when that frame is anchored to the bore hole by operation of the stabilising jacks. The head of the boring machine will move downwardly as boring progresses to enable extension of the shaft lining and the skip guides before the main frame of the boring machine and the transfer station are next moved downwardly. In the arrangement where the transfer station is supported independently of the boring machine it can be moved in incremental steps or substantially continuous movements which may or may not be coupled to the movements of the boring machine.

The invention enables the development of a material transfer and hoisting system as the hole progresses using skips which can be robust and can be hoisted and lowered more rapidly than kibbles and other unguided receptacles. The illustrated system is capable of moving excavated material at a rate equal to that required for removal of material in an operating mine. Typically, using two skips each of 24 tonnes capacity, it is possible to move 10,000 tonnes of excavated material per day. Accordingly, the transfer station and skip hoisting equipment as installed during the shaft sinking operation may be left in position and subsequently used for retrieving material during tunnelling operations and from a subsequently developed operating mine.

The main frame 61 of boring machine 21 includes a bolting deck 62 fitted with four high capacity hydraulic rock drills 63 arranged to drill radially. These are operated during shaft sinking to drill bolt holes for the installation of rock bolts to stabilise the shaft walls. A dust shield 70 is located between the cutter head 23 and the bolting deck 62. Concrete is also applied to the walls by shotcreting through equipment which may also be provided at the bolting deck.

Figure 8:
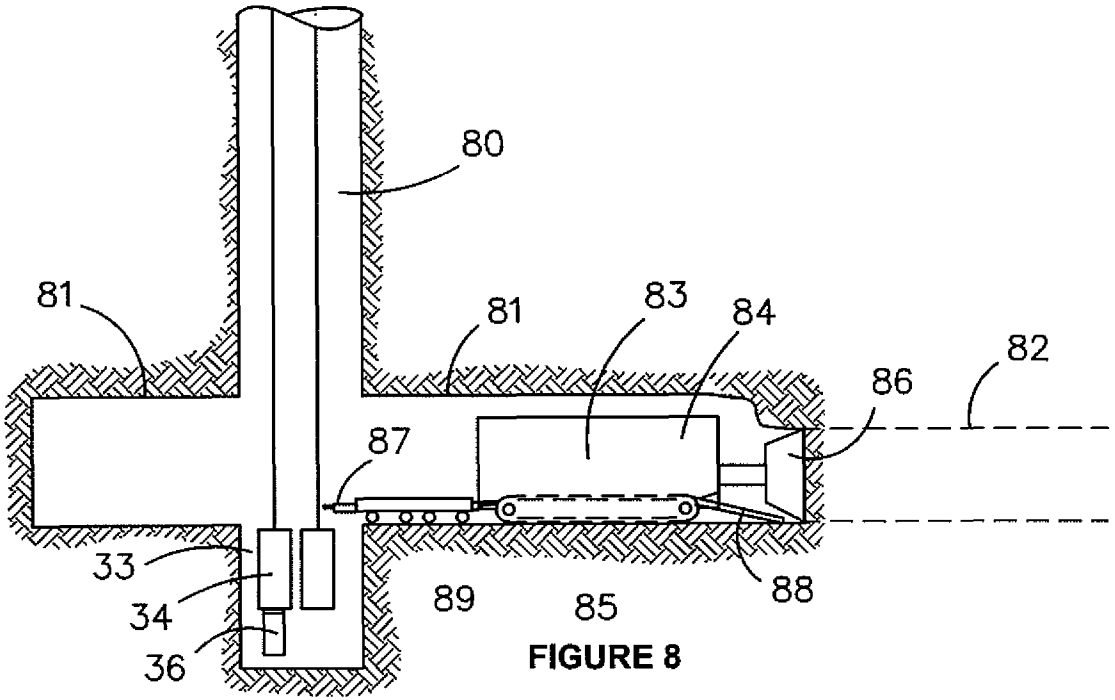
FIGS. 8 to 16 illustrate diagrammatically the manner in which a tunnel or tunnels may be launched outwardly from a shaft.
Figure 9:
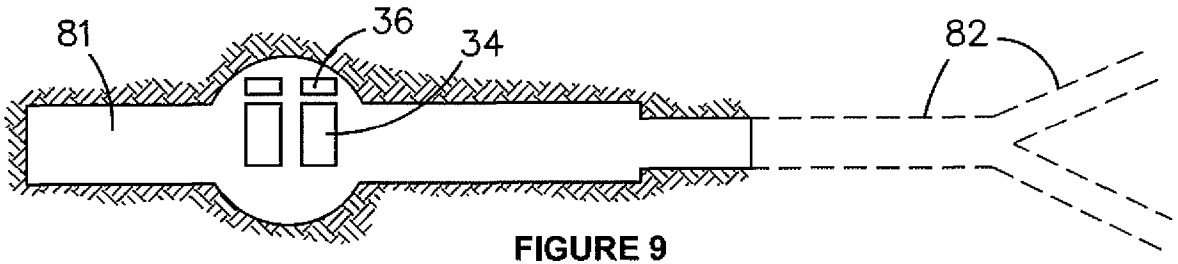

FIGS. 8 to 16 illustrate the manner in which tunnels 82 may be launched from the shaft and material excavated during the tunnelling operations transported to the surface using the material transport system developed during shaft sinking operations. FIGS. 8 and 9 show diagrammatically the bottom part 80 of a shaft from which a cavern 81 has been excavated to extend to opposite sides of the shaft. Cavern 81 may be formed by drilling and blasting and removing material up the shaft using the existing material transport system 22. The cavern is formed so as to have a length and volume sufficient to accommodate a tunnel boring machine 83 which is assembled within the cavern from components lowered down the heavy lifting compartment within the shaft and operated to launch the tunnels 82. Tunnel boring machine 83 may be of a kind conventionally used in civil engineering tunnelling such as in the formation of road and railway tunnels or water pipe tunnels. It may comprise a central body 84 mounted on crawler tracks 85 and provided with a boring head 86 with rotary cutters. The boring machine may include an elongate conveyor such as a chain conveyor 88 extending backwardly from the rotary cutting head to a further extendable conveyor 87 trailed behind the boring machine to deliver excavated material back to the bottom part of the shaft.

In order to form the cavern 81 a shaft station may initially be formed using the rock drills 63 or the bolting deck 62 of the boring machine to drill blast holes in which explosive charges are detonated in stages. After forming a station by this technique further staged drilling and blasting can be carried out to form the enlarged cavern.

FIGS. 10 to 16 illustrate the formation of a shaft station by a sequence of steps or stages as discussed below.

Stage 1

Figure 10:
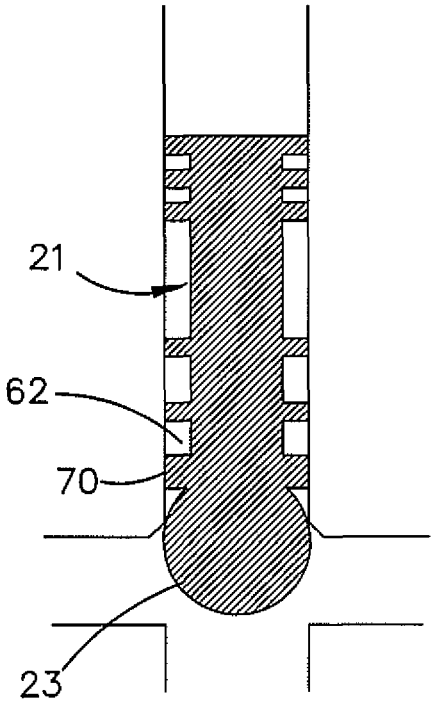

As the shaft boring machine 21 sinks down and approaches the level at which a station is to be formed pilot drills mounted below the bolting deck 62 drill off a brow for the station as shown in FIG. 10.

Stage 2

Figure 11:
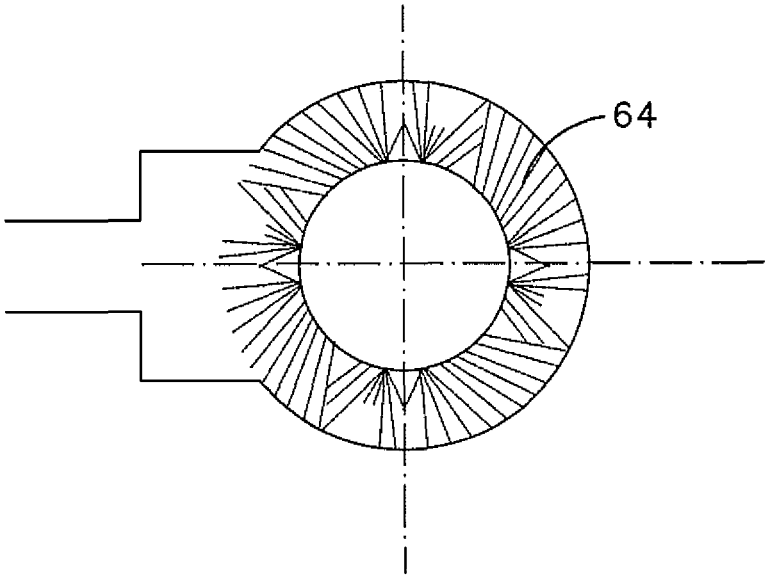

The shaft boring machine 21 continues sinking slowly through the station area with the four bolting drills 63 employed to ring-drill the circular station with holes 64 as shown in FIG. 11. The ring is based on a bolting pattern arranged with a number of "wedge cut" sections to provide free face for blasting. The drills are fitted with "front clamps" for extension drilling and rods are added by hand. The station area may have been shotcreted in the normal way although more shotcrete may have been applied as the station area will not be bolted or, if bolts are required "shell bolts" can be set in some of the ring drill holes and removed for blasting.

Figure 12:
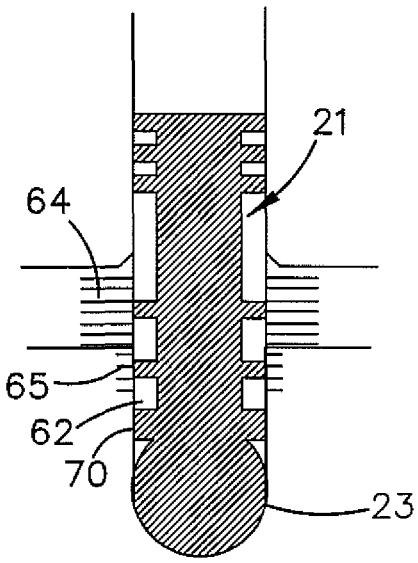

The bolting drills 63 are operated as the shaft boring machine sinks to drill the blast holes in successive planes through the depth of the proposed station so that the station can subsequently be formed in slices by staged blasting. The shaft boring machine then sinks on for approximately 3 meters while additional holes 65 for blasting waste bypass slots or channels are drilled out as shown in FIG. 12. These bypass slots will later be used to drop waste from the station mining to the shaft boring machine cutting wheel for transport as discussed below. The concreting process carried out on the galloway above is held during this process to allow the shaft boring machine to climb above the station during stage blasting operations.

Stage 3

Figure 13:
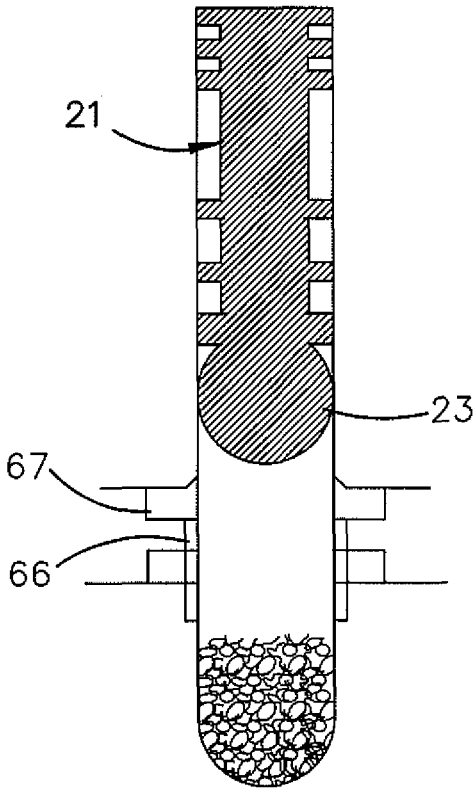
Figure 14:
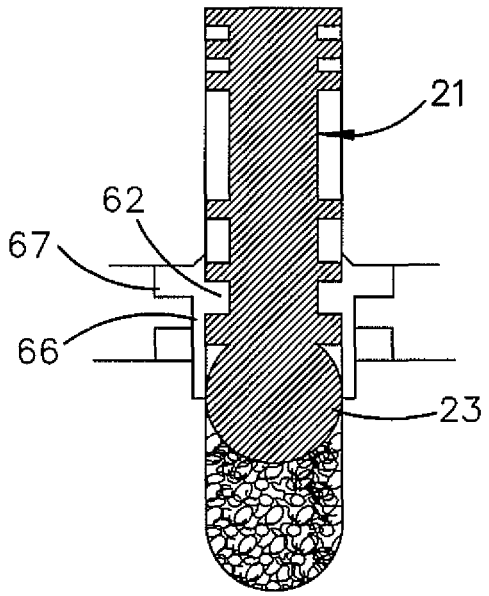

The holes 65 for the waste bypass channels are charged and blasted to form the channels 66 and then a top slice 67 of the station is blasted in stages. The shaft boring machine is climbed out above the station level after each charging as shown in FIG. 13 and the blasting is carried out employing electronic detonators to minimise the maximum instantaneous charge and thereby concussion. The station is divided vertically into approximately 2.5 m high slices 67 for ease of support with handheld equipment.

Stage 4

Figure 15:
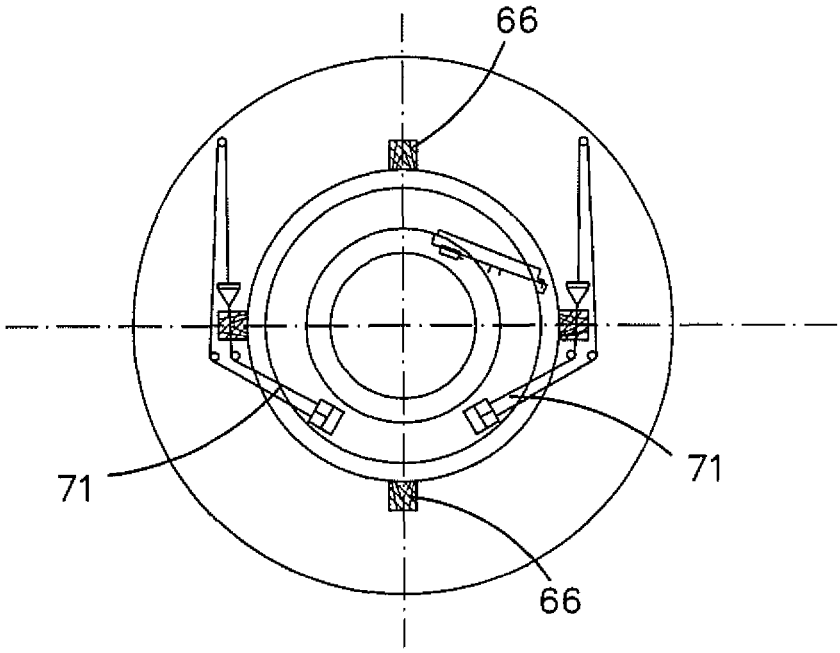

The shaft boring machine 21 is lowered to bring the bolting deck 62 level with the first excavated station slice as shown in FIG. 12. The backs and walls of the first slice 67 are shotcreted and bolted and waste is removed by means of slushers 71 mounted on the bolting deck as shown in FIG. 15, scraping back into the waste bypass channels to bypass the dust shield 70. The shaft boring machine cutter head 23 is run intermittently to load out waste via the skip system.

Stage 5

Figure 16:
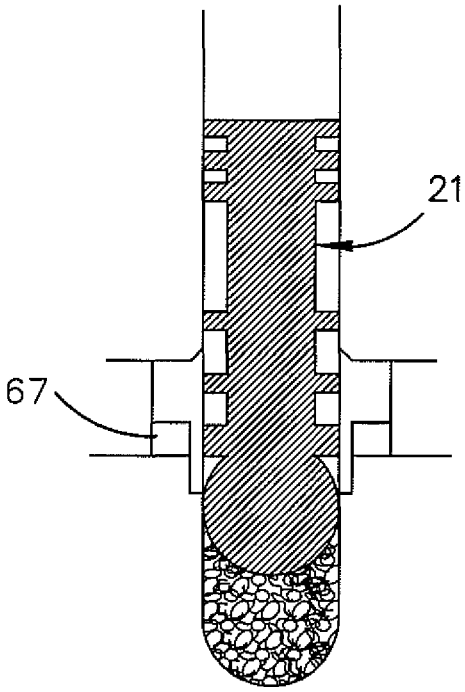

Successive station slices 67 are blasted out and the walls shotcreted and bolted as shown in FIG. 16.

Stage 6

The shaft boring machine carries on sinking below the excavated station. More specifically, the bottom of the shaft may be extended downwardly below the floor of cavern 81 to form a well 89 (FIG. 8) in which the transfer station 33 of the material transport system can be located. The bins or hoppers 34 of the material transport system can thus be located in the well below the floor of the cavern and the skips 36 lowered into the well to receive material dropped into the bins from the conveyor 67.

The boring head 21 of the shaft boring apparatus may be completely or partially salvaged by removing parts and hoisting them through the heavy lift compartment of the shaft prior to the tunnel launching operations. However, this equipment is very large, typically weighing in the order of 1800 tonnes, and salvage may be uneconomical in a project in which the operating costs may exceed $1,000,000 per day. In these circumstances part or the whole of the boring head may be left at the bottom of the hole and buried prior to tunnel launching operations.

The illustrated equipment enables very significant savings in mine development time. However, this equipment has been advanced by way of example only and it may be modified considerably. For example, although maximum benefits can be achieved by assembling and operating a tunnel boring machine for tunnelling operations, this is not essential and it would be possible to launch tunnels by conventional drilling and blasting techniques. Similarly, it would also be possible to modify the shaft boring equipment or to employ a drill and blast technique instead of a mechanical cutting head.

The invention claimed is:

1. A method of developing an underground mine, comprising:

forming a mine shaft by excavating earth from beneath a galloway to form a hole extending downwardly from an earth surface region;

removing excavated material from the hole during the formation of the shaft by a material transport system comprising a material transfer station mounted on the galloway, the material transport system being operable to transport the excavated material, via the transfer station, upwardly through the hole to the earth surface region for discharge at the earth surface region;

locating the galloway and material transfer station at a bottom part of the shaft when formed;

launching one or more tunnels from the bottom part of the shaft by excavating outwardly from the shaft; and removing material excavated in the tunnel excavation by transporting that material from the tunnel to the material transfer station of the material transport system established during formation of the shaft and operating the material transport system to transport the material to the surface region.

2. The method as claimed in claim 1, wherein the tunnel launching is carried out by firstly excavating a cavern at the bottom part of the shaft and then excavating a tunnel or tunnels from the cavern.

3. The method as claimed in claim 2, wherein the cavern is excavated to extend to opposite sides of the shaft.

4. The method as claimed in claim 2, wherein the cavern is excavated by drilling and blasting and removing excavated material.

5. The method as claimed in claim 2, wherein tunnel boring machine components are lowered down the shaft and assembled within the cavern into a tunnel boring machine operable to bore outwardly from the cavern to form the tunnel or tunnels.

6. The method as claimed in claim 1, wherein the galloway comprises part of an excavator and the excavation of earth to form the shaft is carried out by the excavator.

7. The method as claimed in claim 6, wherein the excavator is an earth boring machine comprising a rotary cutting head.

8. The method as claimed in claim 6, wherein, on completion of the shaft formation and prior to the tunnel launch, the excavator is wholly or partly salvaged by removing parts and hoisting the removed parts up the shaft to the earth surface region.

9. The method as claimed in claim 6, wherein the excavator or part of the excavator is buried at the bottom of the shaft prior to the tunnel launch.

10. The method as claimed in claim 1, wherein the material transport system comprises one or more skips moveable up and down on skip guides within the hole.

11. The method as claimed in claim 10, wherein the hole is progressively lined and provided with skip guide extensions as formation of the shaft proceeds.

12. The method as claimed in claim 10, wherein the material excavated in the formation of the shaft is transferred from the transfer station into the skip or skips for transport to the surface region and the transfer station is moved downwardly as excavation progresses.

13. The method as claimed in claim 12, wherein on completion of the shaft formation, the transfer station is at or near the bottom of the shaft and the tunnel excavation material is fed to the transfer station for transfer into the skip or skips.

14. The method as claimed in claim 12, wherein there is a pair of said skips movable up and down within the shaft along adjacent pathways to, in turn, receive excavated material and transport that material to the surface region for discharge at the surface region and to then return downwardly to the transfer station.

15. The method as claimed in claim 14, wherein there is a pair of bins at the transfer station to receive excavated material and to discharge discrete loads of that material intermittently into the skips.

16. The method as claimed in claim 2, wherein the excavation of earth to form the shaft is carried out by an earth boring machine comprising a rotary cutting head disposed below the material transport system for transporting excavated material to the surface region, the earth boring machine is fitted above the cutting head with rock drills operable to drill outwardly extending rock holes about the periphery of the shaft hole and excavation of the cavern is initiated by operating the rock drills to form outwardly extending blast holes about the periphery of the shaft hole at the bottom part of the shaft hole, setting and detonating explosive charges within the blast holes to excavate an initial station from which the cavern and tunnel or tunnels are developed.

17. The method as claimed in claim 16, wherein the blast holes are blasted in stages and the earth boring machine is raised above the blast zone for the blast of each stage.

18. The method as claimed in claim 16, wherein the material excavated by the blasting is allowed or caused to fall to the bottom of the shaft hole and the shaft boring machine is operated to pick up that material and feed it to the material transport system for transport to the surface region.

19. The method as claimed in claim 18, wherein the material transport system comprises one or more skips moveable up and down within the hole and the transfer station at which material excavated in the formation of the shaft is transferred into the skip or skips for transport to the surface region, the transfer station is moved downwardly as excavation progresses and after drilling and blasting to form the enlarged station the earth boring machine is operated to extend the shaft downwardly until the transfer station reaches the launching station and can receive excavated material directly from the launching station and the tunnel or tunnels extended from it.

20. The method as claimed in claim 19, comprising a pair of said skips moveable up and down within the shaft on skip guides and a pair of excavated material storage bins at the transfer station to receive excavated material and to discharge discrete loads of that material intermittently into the skips.

* * * * *